US009612017B2

(12) United States Patent
Vetters

(10) Patent No.: US 9,612,017 B2
(45) Date of Patent: Apr. 4, 2017

(54) COMBUSTOR WITH TILED LINER

(71) Applicant: Rolls-Royce North American Technologies, Inc., Indianapolis, IN (US)

(72) Inventor: Daniel K. Vetters, Indianapolis, IN (US)

(73) Assignee: Rolls-Royce North American Technologies, Inc., Indianapolis, IN (US)

( * ) Notice: Subject to any disclaimer, the term of this patent is extended or adjusted under 35 U.S.C. 154(b) by 104 days.

(21) Appl. No.: 14/695,754

(22) Filed: Apr. 24, 2015

(65) Prior Publication Data

US 2015/0354820 A1 Dec. 10, 2015

Related U.S. Application Data

(60) Provisional application No. 62/008,249, filed on Jun. 5, 2014.

(51) Int. Cl.

| | |
|---|---|
| ***F23R 3/00*** | (2006.01) |
| ***F23R 3/44*** | (2006.01) |
| ***F23M 5/04*** | (2006.01) |
| ***F23R 3/60*** | (2006.01) |

(52) U.S. Cl.

CPC ..... *F23R 3/007* (2013.01); *F23M 5/04* (2013.01); *F23R 3/44* (2013.01); *F23R 3/60* (2013.01); *F23M 2900/05002* (2013.01); *F23R 2900/00017* (2013.01); *Y10T 29/49233* (2015.01)

(58) Field of Classification Search

CPC F23R 3/002; F23R 3/007; F23R 2900/00018; F23M 5/00; F23M 5/04

See application file for complete search history.

(56) References Cited

U.S. PATENT DOCUMENTS

| | | | | |
|---|---|---|---|---|
| 3,854,503 | A | 12/1974 | Nelson et al. | |
| 4,628,694 | A * | 12/1986 | Kelm | B21D 35/00 60/752 |
| 4,944,151 | A | 7/1990 | Hovnanian | |
| 5,392,596 | A | 2/1995 | Holsapple | |
| 5,636,508 | A | 6/1997 | Shaffer | |
| 6,098,397 | A | 8/2000 | Glezer et al. | |
| 6,761,031 | B2 | 7/2004 | Bunker | |
| 7,093,440 | B2 | 8/2006 | Howell et al. | |
| 7,350,360 | B2 | 4/2008 | Graf et al. | |
| 7,441,409 | B2 | 10/2008 | Patel et al. | |

(Continued)

FOREIGN PATENT DOCUMENTS

| | | |
|---|---|---|
| EP | 1152191 A2 | 11/2001 |
| EP | 2085697 A2 | 8/2009 |

(Continued)

OTHER PUBLICATIONS

European Search Report and Written Opinion, European Patent Application No. 15169991.5-1605, Ocotber 8, 2015, 6 pages.

*Primary Examiner* — Justin Larson

(74) *Attorney, Agent, or Firm* — Barnes & Thornburg LLP

(57) ABSTRACT

A combustor for use in a gas turbine engine and methods for assembling the same are disclosed. The combustor includes an outer case and a combustion liner. The combustion liner is arranged radially inward of the outer case. The combustion liner is arranged to define an annular combustion chamber.

18 Claims, 8 Drawing Sheets

(56) References Cited

U.S. PATENT DOCUMENTS

| | | | | |
|---|---|---|---|---|
| 7,540,156 | B2 * | 6/2009 | Brown | F23R 3/002 431/356 |
| 7,647,779 | B2 | 1/2010 | Shi et al. | |
| 7,757,492 | B2 | 7/2010 | Intile et al. | |
| 7,805,946 | B2 | 10/2010 | Ohri et al. | |
| 7,942,004 | B2 | 5/2011 | Hodder | |
| 8,113,004 | B2 * | 2/2012 | Carlisle | F23R 3/002 60/752 |
| 8,122,727 | B2 | 2/2012 | Shi et al. | |
| 8,661,826 | B2 * | 3/2014 | Garry | C23C 4/02 60/752 |
| 8,955,300 | B2 * | 2/2015 | Lo | A44C 5/10 59/78 |
| 9,423,129 | B2 * | 8/2016 | Graves | F23R 3/002 |
| 2006/0216547 | A1 | 9/2006 | Vance | |

FOREIGN PATENT DOCUMENTS

| | | | |
|---|---|---|---|
| EP | 2535645 | A2 | 12/2012 |
| GB | 2359882 | A | 9/2001 |

* cited by examiner

See Fig. 7
See Fig. 8

COMBUSTOR WITH TILED LINER

CROSS REFERENCE TO RELATED APPLICATIONS

This application claims priority to and the benefit of U.S. Provisional Patent Application No. 62/008,249, filed 5 Jun. 2014, the disclosure of which is now expressly incorporated herein by reference.

FIELD OF THE DISCLOSURE

The present disclosure relates generally to gas turbine engines, and more specifically to combustors used in gas turbine engines.

BACKGROUND

Gas turbine engines are used to power aircraft, watercraft, power generators, and the like. Gas turbine engines typically include a compressor, a combustor, and a turbine. The compressor compresses air drawn into the engine and delivers high pressure air to the combustor. In the combustor, fuel is mixed with the high pressure air and is ignited. Products of the combustion reaction in the combustor are directed into the turbine where work is extracted to drive the compressor and, sometimes, an output shaft. Left-over products of the combustion are exhausted out of the turbine and may provide thrust in some applications.

Combustors typically include combustion liners that are adapted to withstand high temperatures produced when fuel is burned in a corresponding combustor. Some combustion liners are made up of multiple tiles arranged circumferentially and axially adjacent one another to define liner walls. The joints between the multiple tiles can provide leak paths for air to pass into the combustor. This leaked in air can reduce efficiency of combustion taking place in the combustor and can be problematic for supplying effective cooling to the combustor.

SUMMARY

The present disclosure may comprise one or more of the following features and combinations thereof.

A combustor for use in a gas turbine engine may include an outer case, a combustion liner, and a mount assembly. The combustion liner may be arranged radially inward of the outer case and may be arranged to define an annular combustion chamber. The combustion liner may include at least one monolithic annular liner tile. The mount assembly may be coupled to the outer case and to the combustion liner to locate the at least one monolithic annular liner tile relative to the outer case.

In some embodiments, the mount assembly may extend from the outer case to the at least one monolithic annular liner tile to locate the combustion liner relative to the outer case. The mount assembly may include at least three mount pins circumferentially spaced apart from one another and a tile hanger that extends from the at least one monolithic annular liner tile to receive each of the at least three mount pins. The tile hanger may include at least three hanger tabs that extend from the at least one monolithic annular liner tile and the hanger tabs may be circumferentially spaced apart from one another to correspond to the at least three mount pins.

In some embodiments, the combustion liner tile may include a first monolithic annular liner tile and a second monolithic annular liner tile. The second monolithic annular liner tile may be arranged radially outward of the first monolithic annular liner tile and the combustion chamber may extend radially between the second monolithic annular liner tile and the first monolithic annular liner tile. The mount assembly may include a plurality of mount pins that extend from the outer case, a first tile hanger that extends from the first monolithic annular liner tile to receive each of the mount pins, and a second tile hanger that extends from the second monolithic annular liner tile to receive each of the mount pins.

In some embodiments, the second monolithic annular liner tile may be arranged axially adjacent to the first monolithic annular liner tile. The first monolithic annular liner tile may be substantially cylindrical and the second monolithic annular liner tile may be substantially frustoconical. The combustion liner may include a plurality of circumferentially adjacent liner tiles arranged radially outward of the at least one monolithic annular liner tile and the combustion chamber may extend radially between the plurality of circumferentially adjacent liner tiles and the at least one monolithic annular liner tile.

In some embodiments, the combustor may also include an inner case that defines an annular liner-receiving cavity in which the combustion liner is mounted. The mount assembly may extend from the outer case to the inner case to locate the inner case and the combustion liner relative to the outer case. The at least one monolithic annular liner tile may be coupled to the inner case by a plurality of studs that extend radially from the at least one monolithic annular liner tile to the inner case. The inner case may include a stud locator. The stud locator may be formed to include a first plurality of axially-extending slots and a stud retainer formed to include a second plurality of axially-extending slots. The first and second plurality of axially-extending slots may cooperate to axially trap the plurality of studs that extend from the at least one monolithic annular liner tile when the combustor is assembled.

According to another aspect of the present disclosure, a combustor for use in a gas turbine engine is described. The combustor may include a mount plate, a combustion liner, and a plurality of studs. The mount plate may be formed to include a first axial end, a second axial end, and a plurality of slots circumferentially spaced from one another. The first axial end may have a first diameter and the second axial end may have a second diameter different than the first diameter. The combustion liner may be arranged to define an annular combustion chamber. The combustion liner may include at least a first monolithic annular liner tile. The first monolithic annular liner tile may be formed to include a first axial end and a second axial end. The first axial end may have a first diameter and the second axial end may have a second diameter different than the first diameter corresponding to the first and second diameters of the first and second axial ends of the mount plate. The plurality of studs may extend substantially perpendicularly from the inner surface of the first monolithic annular liner tile and may be circumferentially spaced from one another to correspond to the plurality of slots to be received therein to couple the first monolithic annular liner tile to the mount plate.

In some embodiments, the combustor may include an inner case that defines an annular liner-receiving cavity in which the combustion liner is mounted. The inner case may include the mount plate.

In some embodiments, the combustion liner may include a second monolithic annular liner tile. The second monolithic annular liner tile may include the mount plate.

In some embodiments, the combustion liner may include a second monolithic annular liner tile. The mount plate may be coupled to the second monolithic annular liner tile by a series of fasteners.

In some embodiments, the plurality of the slots may include at least a first slot and a second slot. The first slot may be radially and axially spaced apart from the second slot. The plurality of studs may include at least a first stud and a second stud. The first stud may be radially and axially spaced apart from the second stud.

According to another aspect of the present disclosure, a method of assembling a combustor for use in a gas turbine engine is described. The method may include positioning a combustion liner radially inward of an outer case and securing a plurality of mount pins to the outer case. The combustion liner may be arranged to define an annular combustion chamber that extends around a central axis and may include at least one monolithic annular liner tile that extends around the central axis. The mount pins may be circumferentially spaced from one another and may engage the at least one monolithic annular liner tile to locate the at least one monolithic annular liner tile relative to the outer case.

In some embodiments, the combustion liner may include a first monolithic annular liner tile and a second monolithic annular liner tile. The first monolithic annular liner tile may be engaged by the plurality of mount pins. The second monolithic annular liner tile may be formed to taper from a first axial end having a first diameter to a second axial end having a second diameter different from the first diameter. In some embodiments, the method may also include mounting the second monolithic annular liner tile relative to the outer case by moving the second monolithic annular liner tile along the central axis and passing a plurality of studs that extend from the second monolithic annular liner tile in a substantially perpendicular direction from the second monolithic annular liner tile into axially and radially extending slots formed in a mount plate.

These and other features of the present disclosure will become more apparent from the following description of the illustrative embodiments.

BRIEF DESCRIPTION OF THE DRAWINGS

FIG. 3 is a partial cross-sectional view of the combustor shown in FIG. 2 showing outer liner tiles being secured to an outer skin of an inner case of the combustion housing and a sloped annular liner tile being coupled to an inner skin of the inner case;

FIG. 4 is a partial cross-sectional view of the combustor shown in FIG. 3 showing a cylindrical annular liner tile being arranged to surround a portion of the inner skin;

FIG. 5 is a partial cross-sectional view of the combustor shown in FIG. 4 showing an inlet assembly being positioned at a forward portion of the combustor and a mount pin being positioned to secure the combustion housing to the outer case;

FIG. 6 is a partial cross-sectional view of the combustor shown in FIG. 5 showing the assembled combustor;

DETAILED DESCRIPTION OF THE DRAWINGS

Figure 1:
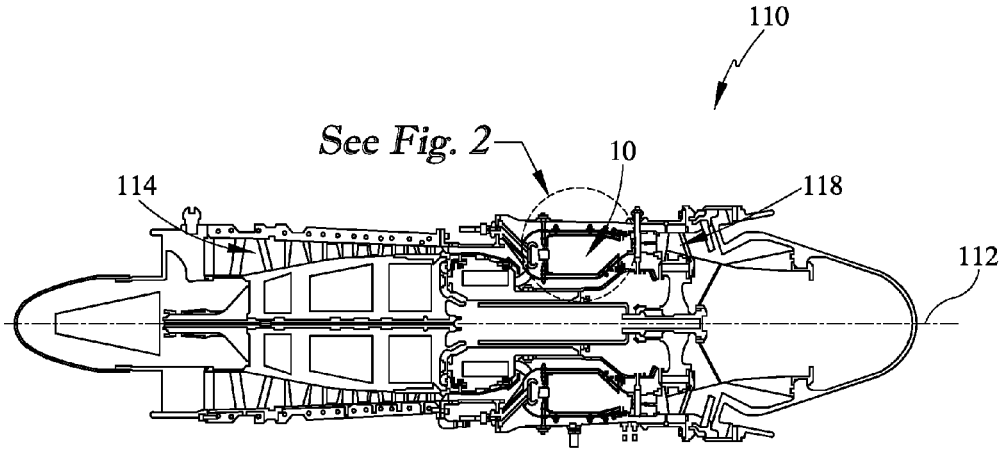
FIG. 1 is a cut-away view of a gas turbine engine including a combustor in accordance with the present disclosure.

For the purposes of promoting an understanding of the principles of the disclosure, reference will now be made to a number of illustrative embodiments illustrated in the drawings and specific language will be used to describe the same.

An illustrative gas turbine engine 110 includes a compressor 114, a combustor 10, and a turbine 118 arranged along an engine axis 112 as shown in FIG. 1. The compressor 114 is configured to compress and deliver air to the combustor 10. The combustor 10 is mixes fuel with the compressed air received from the compressor 114 and ignites the fuel. The hot, high pressure products of the combustion reaction in the combustor 10 are directed into the turbine 118 and the turbine 118 extracts work to drive the compressor 114 and provide thrust.

Figure 2:
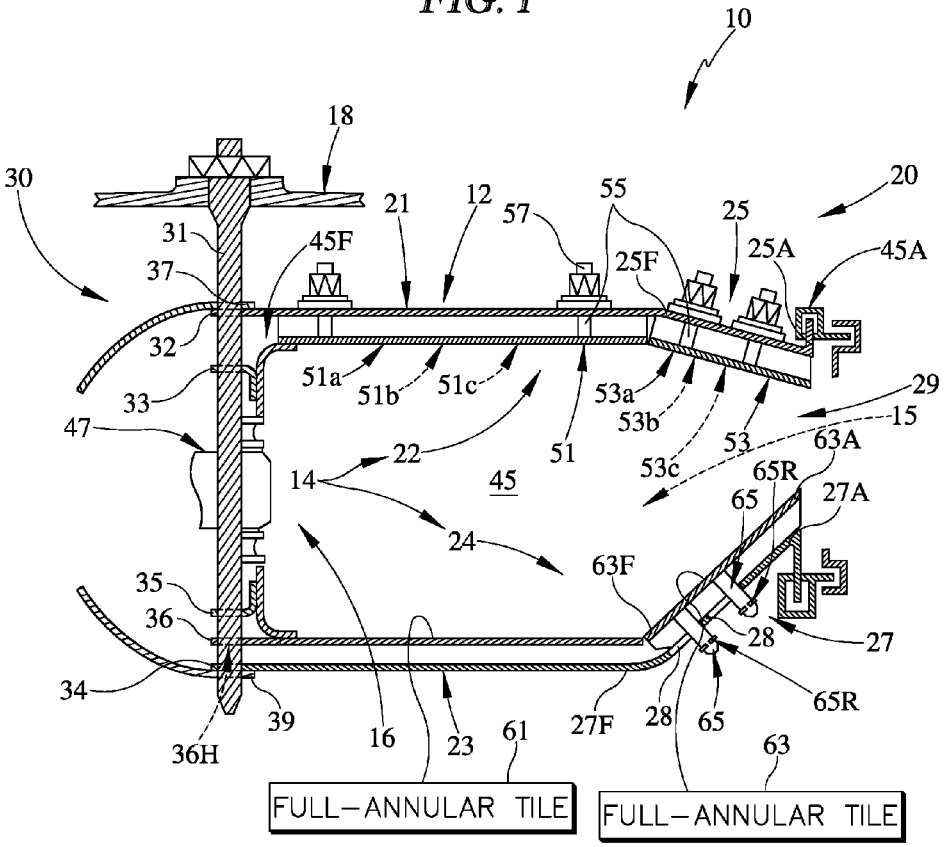
FIG. 2 is a partial cross-sectional view of the combustor shown in FIG. 1 showing that the combustor includes an outer case, a combustion housing with a combustion liner, and a mount assembly coupled between the outer case and the combustion housing and showing that the combustion liner of the combustion liner includes full-annular liner tiles.

The combustor 10 includes an outer case 18, a combustion housing 20, and a mount assembly 30 for connecting the combustion housing 20 to the outer case 18 as shown, for example, in FIG. 2. The combustion housing 20 generally includes an inner case 12, a combustion liner 14, and a fuel inlet assembly 16. The inner case 12 is constructed from a metallic material and defines an annular cavity 15. The combustion liner 14 is arranged inside the cavity 15 defined by the inner case 12 and extends around an annular combustion chamber 45 in which fuel is ignited to produce hot, high-temperature gases that drive the gas turbine engine 110. The fuel inlet assembly 16 is arranged at an axially forward end 45F of the combustion chamber 45 and provides fuel to the combustion chamber 45 through a plurality of fuel nozzles 47. The combustor 10 feeds hot, high-pressure gas through an outlet 29 arranged at an axially aft end 45A of the combustion chamber 45 that is used to drive the turbine 118 of the gas turbine engine 110.

In the illustrative embodiment, the gas turbine engine 110 is a relatively-low diameter engine adapted for specific applications such as munitions (e.g. missiles), unmanned aerial vehicles (UAVs), and the like. On account of the relatively-low diameter of the gas turbine engine 110, monolithic annular components may be manufactured and assembled into the engine 110 with relative ease. However, the use of monolithic annular components in relatively-high diameter gas turbine engine is also contemplated and may be incorporated in some applications. In the illustrative embodiment, the combustion liner 14 includes monolithic, full-annular inner liner tiles 61, 63 as suggested in FIG. 2. The monolithic annular liner tiles 61, 63 extend all the way around engine axis 112 without axially-extending joints/gaps. This arrangement reduces the number of parts needed to assemble the combustor 10.

One of the monolithic annular liner tiles 61 has a generally constant diameter as shown, for example, in FIG. 2. The mount assembly 30 holds the liner tiles 61 in place relative to the outer case 18. Particularly, the mount assembly 30 includes a plurality of pins 31 and a tile hanger 36 that cooperates to couple the monolithic annular liner tile 61 to the outer case 18. The pins 31 are spaced circumferentially around the combustor 10 and extend from the outer case 18 into holes 36H formed in the tile hanger 36. In the illustrative embodiment, the tile hanger 36 is formed with the monolithic annular liner tile 61 as shown in FIG. 2.

The other monolithic annular liner tile 63 has an expanding diameter to define a constriction of the combustion chamber 45 as shown, for example, in FIG. 2. A series of circumferentially and axially spaced apart studs 65 holds the liner tile 63 in place relative to the outer case 18 by coupling the annular liner tile 63 to the inner case 12. The studs 65 extend axially from the annular liner tile 63 and into elongated slots 28 formed in a portion 27 of the inner case 12 having an expanding diameter that corresponds to diameter of the liner tile 63. The elongated slots 28 accommodate movement of the circumferentially and axially spaced apart studs 65 relative to the inner case 12 so that the liner tile 63 can be mounted in place relative to the inner case 12 and the outer case 18.

The inner case 12 illustratively includes an outer skin 21 and an inner skin 23 that is generally concentric with and nested inside the outer skin 21. To direct the hot, high-temperature gases produced in the combustion chamber 45 toward the outlet 29, the outer skin 21 includes a radially sloped section 25 and the inner skin 23 includes a radially sloped section (or mount plate) 27 as shown in FIG. 2. The radially sloped sections 25, 27 converge to form the outlet 29.

The radially sloped section 25 of the outer skin 21 is formed to include an axially forward end 25F and an axially aft end 25A. In the illustrative embodiment, the axially aft end 25A has a diameter smaller than the diameter of the axially forward end 25F and the diameter of the radially sloped section 25 linearly decreases from the axially forward end 25F toward the axially aft end 25A so the radially sloped section 25 assumes a substantially frustoconical shape. However, it should be noted that the diameter may decrease in a non-linear fashion.

The radially sloped section 27 of the inner skin 23 is formed to include an axially forward end 27F and an axially aft end 27A. In the illustrative embodiment, the axially aft end 27A has a diameter larger than the diameter of the axially forward end 27F and the diameter of the radially sloped section 27 linearly increases from the axially forward end 27F toward the axially aft end 27A so the radially sloped section 27 assumes a substantially frustoconical shape. However, it should be noted that the diameter may increase in a non-linear fashion.

The combustion liner 14 includes an outer liner wall 22 and an inner liner wall 24 as shown in FIG. 2. The outer liner wall 22 is illustratively assembled from outer liner tiles 51, 53 that are included each in a plurality of outer liner tiles 51*a*, 51*b*, 51*c*, 53*a*, 53*b*, 53*c* tiled circumferentially adjacent to one another around the circumference of the outer skin 21. The inner liner wall 24 is illustratively assembled from a plurality of inner liner tiles 61, 63 that are each monolithic annular components that extend around the engine axis 112 without joints/gaps.

The outer liner wall 22 is illustratively assembled from a plurality of outer liner tiles 51, 53 secured to the inner case 12 by a plurality of radially-extending studs 55 and nuts 57. The outer liner tiles 51, 53 are arranged to shield the outer skin 21 from the hot, high-temperature gases produced within the combustion chamber 45 and to contain the hot, high-temperature gases within the combustion chamber 45 as they are directed toward the outlet 29. The outer liner tiles 51, 53 are formed of a high temperature resistant material for use in an environment where the temperature can be in excess of 3000 degrees Fahrenheit. For example, the outer liner tiles 51, 53 may be a multi-wall perforated structure formed of a high temperature resistant metallic material, such as, but not limited to, HASTELLOY® X, MAR-M247 ®, LAMILLOY®, or an intermetallic material. Alternatively, the outer liner tiles 51, 53 may be formed of a ceramic material or ceramic matrix composite (CMC), with or without perforations. In another embodiment, the outer liner tiles 51, 53 may be monolithic annular liner tiles mounted and assembled as later described herein.

The inner liner wall 24 is illustratively assembled from a plurality of inner liner tiles 61, 63. In the illustrative embodiment, each inner liner tile 61, 63 is monolithic and annular, and arranged to surround portions of the inner skin 23 as shown in FIG. 2. The inner liner tiles 61, 63 are arranged to shield the inner skin 23 from the hot, high-temperature gases produced within the combustion chamber 45 and to contain the hot, high-temperature gases within the combustion chamber 45 as they are directed toward the outlet 29. The inner liner tiles 61, 63 are formed of a high temperature resistant material for use in an environment where the temperature can be in excess of 3000 degrees Fahrenheit. For example, the inner liner tiles 61, 63 may be a multi-wall perforated structure formed of a high temperature resistant metallic material, such as, but not limited to, HASTELLOY® X, MAR-M247 ®, LAMILLOY®, or an intermetallic material. Alternatively, the inner liner tiles 61, 63 may be formed of a ceramic material or ceramic matrix composite (CMC), with or without perforations.

The mount assembly 30 generally includes at least three mount pins 31 arranged around the circumference of the outer case 18 and various hangers 32-39 that receive the mount pins 31 to position the combustion housing 20 relative to the outer case 18 as shown in FIG. 2. In the illustrative embodiment, the inner case 12 includes an outer skin hanger 32 and an inner skin hanger 34 positioned for engagement with the mount pins 31 to locate the inner case 12 relative to the outer case 18. Similarly, the fuel inlet assembly 16 includes inlet hangers 33, 35, 37, 39 positioned for engagement with the mount pins 31 to locate the fuel inlet assembly 16 at the axially forward end 45F of the combustion chamber 45 and relative to the outer case 18.

Inner liner tile 61 includes the tile hanger 36 positioned for engagement with the mount pins 31 to locate the liner tile 61 relative to the outer case 18 as shown in FIG. 2. In one embodiment, the tile hanger 36 is integral with the inner liner tile 61 and includes an annular band of material formed to include a plurality of holes 36H circumferentially positioned corresponding to the layout of the mount pins 31. The mount pins 31 extend through the outer case 18 and through the holes 36H to position the inner liner tile 61 both axially and radially relative to the outer case 18. The holes 36H allow the inner liner tile 61 to radially expand and contract due to the heat generated in the combustion chamber 45 while maintaining the axial position of the inner liner tile 61. In another embodiment, the tile hanger 36 may be processed to form a plurality of hanger tabs positioned around the circumference of the inner liner tile 61 corresponding to the layout of the mount pins 31. Each hanger tab includes at least one of the holes 36H.

The inner liner tile 61 is positioned to surround an axially forward portion of the inner skin 23 as shown in FIG. 2. In the illustrative embodiment, the inner liner tile 61 is substantially cylindrical and the corresponding portion of the inner skin 23 is also substantially cylindrical. However, it should be noted that other shapes or profiles for the inner liner tile 61 and inner skin 23 may be used. For example, the inner skin 23 and inner liner tile 61 may have matching non-cylindrical profiles or have non-matching profiles where one is substantially cylindrical and the other is non-cylindrical.

Inner liner tile 63 includes a plurality of studs 65 arranged around the circumference of the inner liner tile 63 as suggested in FIG. 2. The studs 65 are received in slots 28 formed in the sloped section 27 to couple the inner liner tile 63 to the inner skin 23. The slots 28 are positioned around the circumference of the sloped section 27 corresponding to the layout of the studs 65. In one embodiment, the circumferentially adjacent studs 65 are axially and radially offset from one another. In the illustrative embodiment, a retainer ring (or snap ring) 65R is used to retain the studs 65 within the slots 28 allowing the inner liner tile 63 to radially expand and contract due to the heat generated in the combustion chamber 45. However, it should be noted that other types of retainers may be used such as, for example, nuts threaded onto the studs 65.

The inner liner tile 61 is positioned to surround sloped section 27 of the inner skin 23 as shown in FIG. 2. In the illustrative embodiment, the inner liner tile 63 is formed to include an axially forward end 63F and an axially aft end 63A. The axially aft end 63A has a diameter larger than the diameter of the axially forward end 63F and the diameter of the inner liner tile 63 linearly increases from the axially forward end 63F toward the axially aft end 63A so the inner liner tile 63 assumes a substantially frustoconical shape. However, it should be noted that the diameter may increase in a non-linear fashion. Once the inner liner tile 63 is coupled to the inner skin 23, the mount pins 31 engage the inner skin hanger 34 to position the inner skin 23 and inner liner tile 63 relative to the outer case 18.

As noted above, the outer liner tiles 51, 53 may be mounted and arranged in similar fashion to the inner liner tiles 61, 63 such that the outer liner tiles 51, 53 are monolithic and annular. The use of monolithic annular tiles eliminates joints between circumferentially adjacent liner tiles which may allow combustion products to leak out of the combustion chamber 45 and lower the efficiency of the gas turbine engine 110. Limiting the number of joints increases the efficiency of the gas turbine engine 110, and this is especially true for smaller diameter engines where the joints may comprise a higher unit area of the combustor than in a larger engine. The use of monolithic annular tiles may also ease manufacturing and assembly of combustors by reducing the number of parts included in such assembly.

Figures 3, 4, 5, 6:
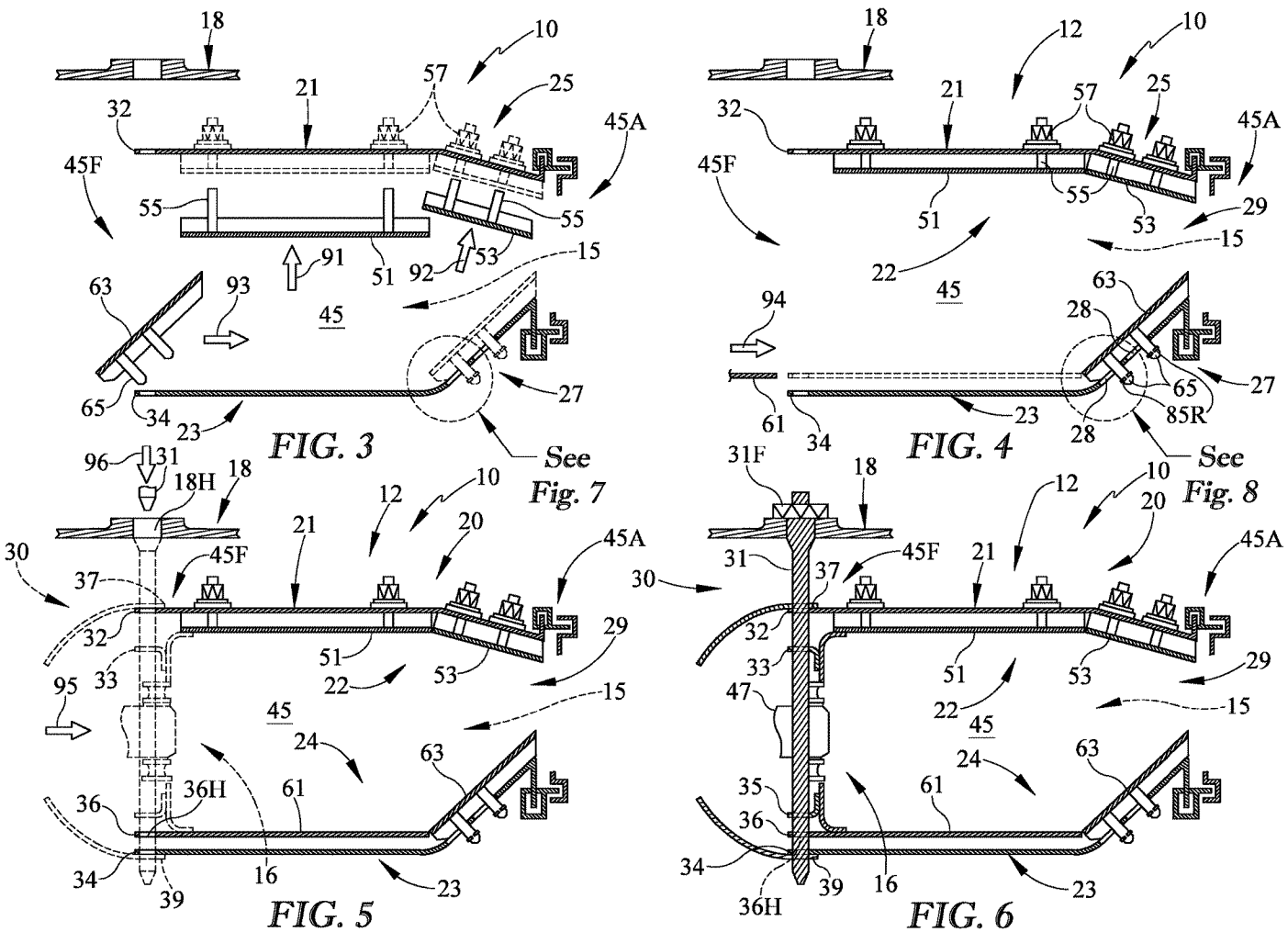
FIGS. 3-6 are a series of partial cross-sectional views showing the combustor of FIG. 2 being assembled.
Figure 8:
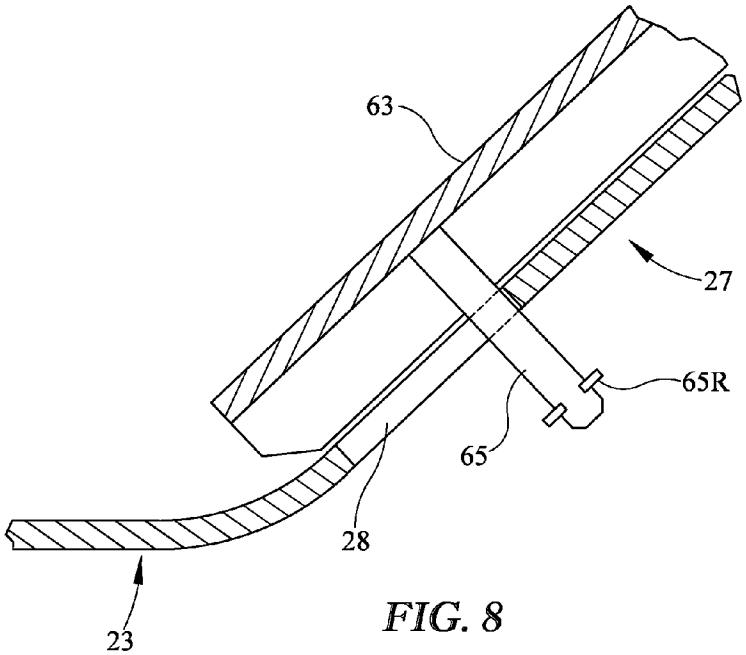
FIG. 8 is a partial cross-sectional view of the combustor shown in FIG. 8 showing that the stud mates with the upper portion of the slot formed in the inner skin of the inner case to locate the sloped annular liner tile relative to the outer case.

Assembly of the illustrative combustor 10 is generally shown in FIGS. 3-8. The inner case 12 is positioned radially inward of the outer case 18 as shown in FIG. 3. It should be noted that the outer skin 21 and inner skin 23 may be positioned within the outer case 18 together or independently. In the illustrative embodiment, the outer liner tiles 51 are coupled to the outer skin 21 as suggested by arrow 91, and the outer liner tiles 53 are coupled to the sloped section 25 of the outer skin 21 as suggested by arrow 92. The outer liner tiles 51, 53 are each coupled to the outer skin 21 by passing the radially-extending studs 55 through holes formed in the outer skin 21 and then securing them in place with the nuts 57. In one embodiment, the outer liner tiles 51, 53 are coupled to the outer skin 21 prior to the outer skin 21 being positioned within the outer case 18.

Figure 7:
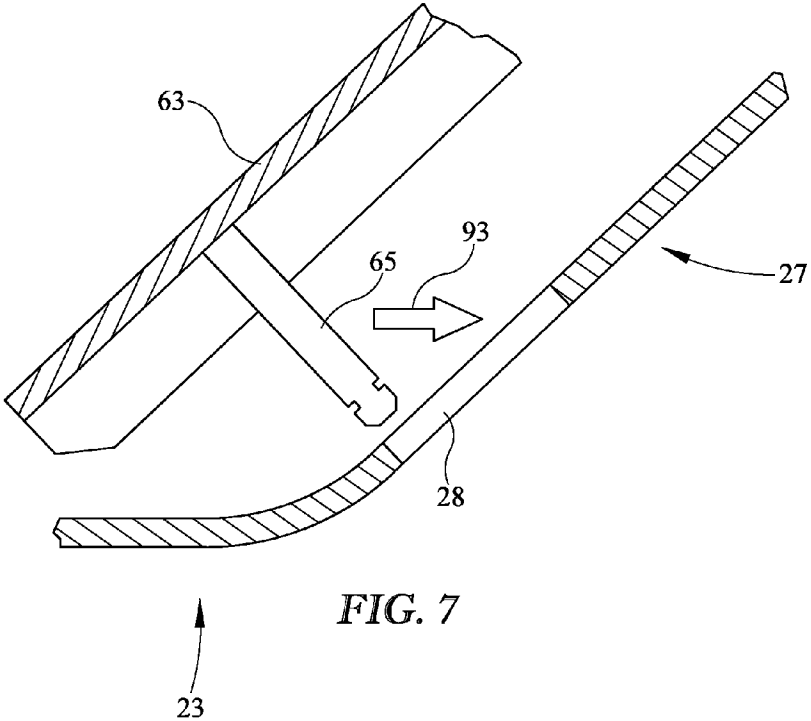
FIG. 7 is a partial cross-sectional view of the combustor shown in FIG. 3 showing that the end of a stud coupled to the inner surface of the sloped annular liner tile passes over the lower portion of a slot formed in the inner skin of the inner case as the sloped annular liner tile is coupled to the inner skin.

In the illustrative embodiment, inner liner tile 63 travels in an axial direction from the axially forward end 45F of the combustion chamber 45 toward the axially aft end 45A of the combustion chamber 45, as suggested by arrow 93, and couples to the sloped section 27 of the inner skin 23 as suggested in FIG. 3. The inner liner tile 63 is positioned such that the studs 65 coupled to the inner liner tile 63 may pass over a lower end of the slots 28 to pass into the slots 28 as shown in FIG. 7. The studs 65 may then pass into the slots 28 and the retainer rings 65R are positioned on the studs 65 to couple the inner liner tile 63 to the sloped section 27 of the inner skin 23 as suggested in FIGS. 4 and 8. In one embodiment, the inner liner tile 63 is coupled to the inner skin 23 prior to the inner skin 23 being positioned within the outer case 18.

Inner liner tile 61 travels in an axial direction from the axially forward end 45F of the combustion chamber 45 toward the axially aft end 45A of the combustion chamber 45, as suggested by arrow 94, and is positioned to surround the forward portion of the inner skin 23 as suggested in FIG. 4. In the illustrative embodiment, the inner liner tile 63 is coupled to the inner skin 23 prior to the inner liner tile 61 being positioned. However, other sequences are contemplated as will be later described herein.

The fuel inlet assembly 16 is positioned to enclose the axially forward end 45F of the combustion chamber 45 as suggested by arrow 95 in FIG. 5. The various hangers 32-39 are positioned in alignment with a plurality of holes 18H formed in the outer case 18 for receiving the mount pins 31. The mount pins 31 may then pass through the various hangers 32-39, as suggested by arrow 96, to locate the combustion housing 20 relative to the outer case 18. The mount pins 31 are then fastened to the outer case 18 by a plurality of fasteners 31F as suggested in FIG. 6. In one embodiment, the combustion housing 20 may be preassembled and positioned within the outer case 18 as a single unit before the mount pins 31 are inserted.

Figure 9:
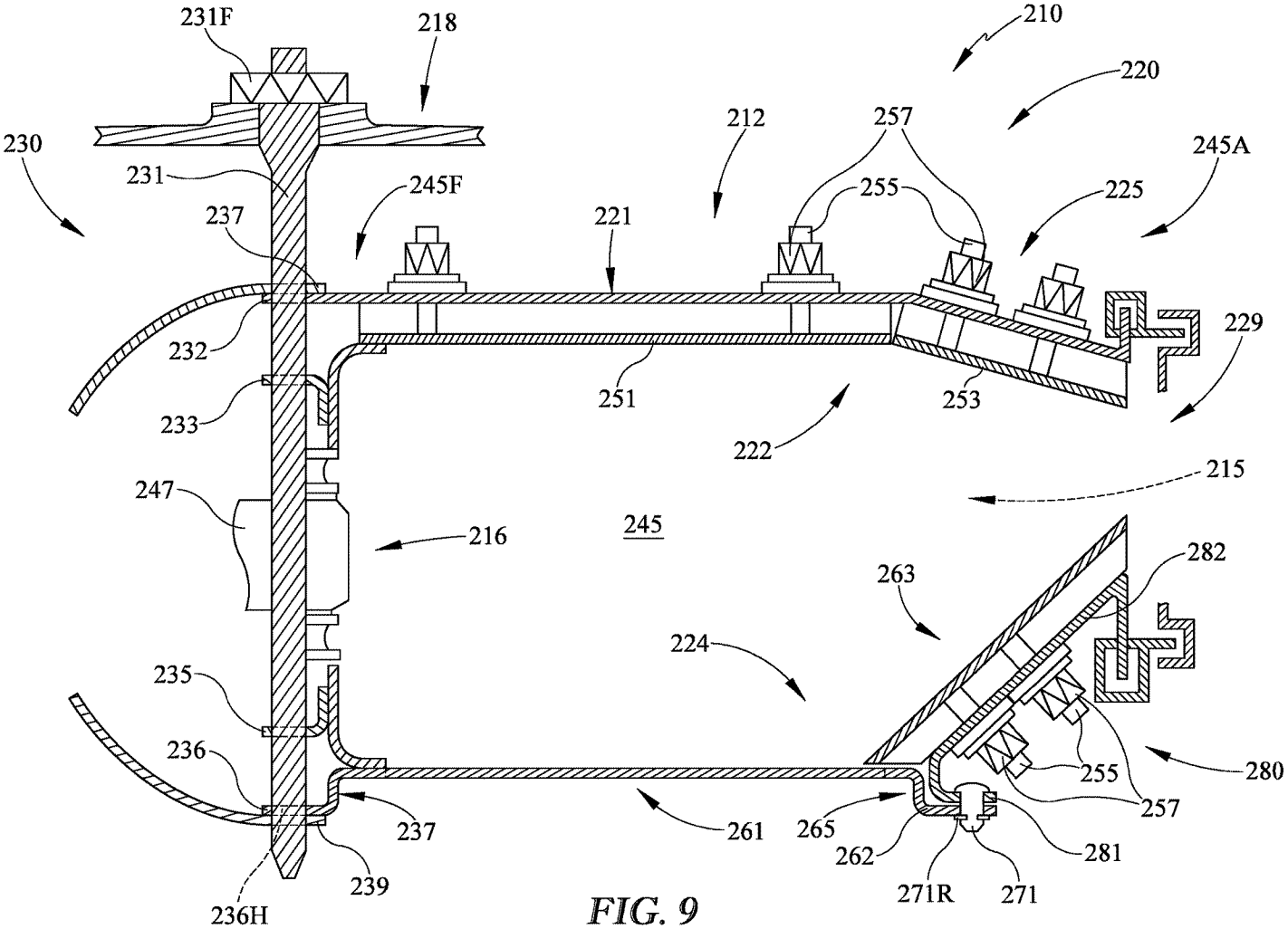
FIG. 9 is a partial cross-sectional view of a second combustor showing that an annular liner tile replaces a portion of the inner skin of the inner case.

Another illustrative combustor 210 adapted for use in the gas turbine engine 110 is shown in FIG. 9. The combustor 210 is substantially similar to the combustor 10 shown in FIGS. 2-8 described herein. Accordingly, similar reference numbers in the 200 series indicate features that are generally common between the combustor 10 and the combustor 210. The description of the combustor 10 is hereby incorporated by reference to apply to the combustor 210, except in instances when it conflicts with the specific description and drawings of combustor 210.

Unlike the combustor 10, the inner case 212 of the combustion housing 220 included in the combustor 210 does not include an inner skin corresponding to the inner skin 23 of the combustor 10 as shown in FIG. 9. Rather, the inner liner tile 261 supports the other inner liner tiles 263 when it is attached to the mount pins 231. In the illustrative embodiment, the inner liner tile 261 includes a forward tile hanger 236 and an aft tile hanger 262. The forward tile hanger 236 is substantially similar to the tile hanger 36 of FIGS. 2-8 except that it includes an offsetting step 237 to position the inner liner tile 261 and mate with a lower portion of the fuel inlet assembly 216 to provide an enclosed combustion chamber 245. However, the forward tile hanger 236 may not include an offsetting step, and the lower portion of the fuel inlet assembly 216 may be sized to adjust for the difference.

The aft tile hanger 262 is arranged to couple with a mount plate 280 for mounting of the inner liner tiles 263 as shown in FIG. 9. The mount plate 280 is generally annular, and includes a mounting tab 281 for mating with the aft tile hanger 262 and a sloped body section 282 for coupling the inner liner tiles 263. The mounting tab 281 is coupled to the aft tile hanger 261 by a coupler pin 271 which passes through holes included in the aft tile hanger 262 and mounting tab 281 and is held in place with a coupler pin retainer 271R. The coupler pin 271 allows for independent radial expansion and contraction of the inner liner tile 261 and mount plate 280 due to heat generated in the combustion chamber 245. The aft tile hanger 262 illustratively includes an offsetting step 265 allowing for insertion of the coupler pin 271 during positioning of the mount plate 280. The aft tile hanger 262 and mounting tab 281 may be annular, a plurality of tabs circumferentially spaced around the inner liner tile 261 and mount plate 280, or a combination thereof. The mount plate 280 may also be used in the combustor 10 of FIGS. 2-8 such that the sloped section 27 of the inner skin 23 is replaced with the mount plate 280 to mount the inner liner tile 63.

In the illustrative embodiment, a plurality of inner liner tiles 263 are coupled to the mount plate 280 and arranged around the circumference thereof. The inner liner tiles 263 are attached to the mount plate 280 with studs 255 and nuts 257 as shown in FIG. 9. The inner liner tiles 263 may be coupled to the mount plate 280 before or after the mount plate 280 is coupled to the inner liner tile 261. In another embodiment, a monolithic annular liner tile may be used in place of the plurality of inner liner tiles 263 and coupled to the mount plate 280 as already described herein.

Figure 10:
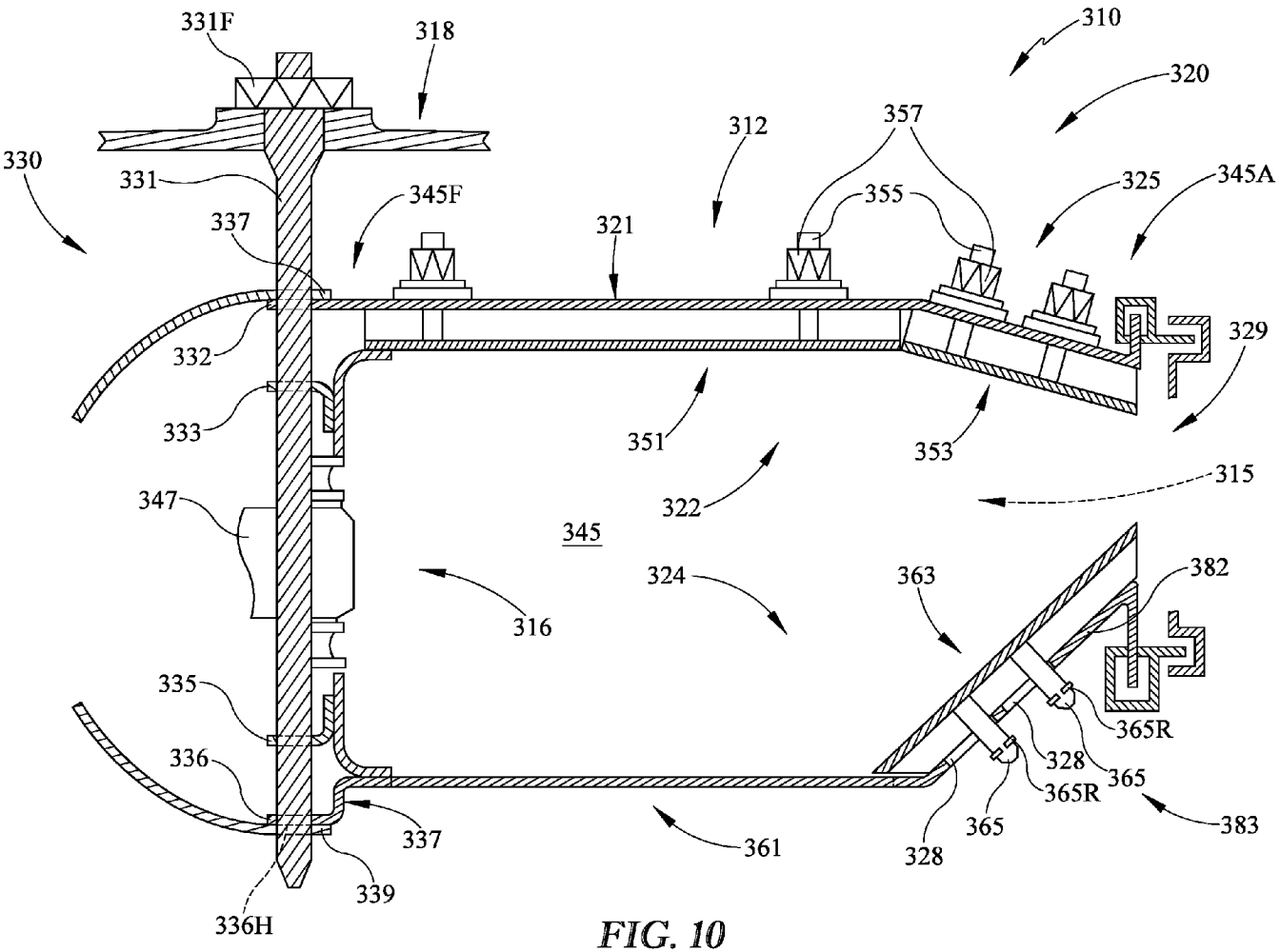
FIG. 10 is a partial cross-sectional view of a third combustor showing that an annular liner tile completely replaces the inner skin of the inner case.

Another illustrative combustor 310 adapted for use in the gas turbine engine 110 is shown in FIG. 10. The combustor 310 is substantially similar to the combustor 210 shown in FIG. 9 described herein. Accordingly, similar reference numbers in the 300 series indicate features that are generally common between the combustor 210 and the combustor 310. The description of the combustor 210 is hereby incorporated by reference to apply to the combustor 310, except in instances when it conflicts with the specific description and drawings of combustor 310.

Similar to the combustor 210, the inner case 312 of the combustion housing 320 included in the combustor 310 does not include an inner skin corresponding to the inner skin 23 of the combustor 10 as shown in FIG. 10. Rather, the inner liner tile 361 supports the other inner liner tiles 363 when it is attached to the mount pins 331. In the illustrative embodiment, the inner liner tile 361 includes a forward tile hanger 336 and a radially sloped section (or mount plate) 383. The forward tile hanger 336 is substantially similar to the tile hanger 236 of FIG. 9 including an offsetting step 337 to position the inner liner tile 361. However, the forward tile hanger 336 may not include an offsetting step, and the lower portion of the fuel inlet assembly 316 may be sized to adjust for the difference.

The mount plate 383 is arranged for mounting of the inner liner tile 363 as shown in FIG. 10. In the illustrative embodiment, the inner liner tile 363 is monolithic and annular. The mount plate 383 is generally annular, and includes a sloped body section 382 for coupling the inner liner tile 363 and elongated slots 328 to accommodate circumferentially and axially spaced apart studs 365 coupled to the inner liner tile 363. The elongated slots 328 allow movement of the studs 365 relative to the inner case 312 so that the inner liner tile 363 can be mounted in place relative to the inner case 312 and the outer case 318. The elongated slots 328 also allow for assembly of the combustion housing 320 in similar fashion to the combustion housing 20 described above in regard to FIGS. 3-6. A retainer ring (or snap ring) 365R is used to retain the studs 365 within the slots 328 allowing the inner liner tile 363 to radially expand and contract due to the heat generated in the combustion chamber 345.

Inner liner tile 361 allows for greater ease of assembly and weight savings because an inner skin does not need to be incorporated and a limited number of components need to be mounted in order to form the combustion chamber 345. Further ease of assembly and weight savings can be realized by adapting the outer liner tiles 351, 353 to be mounted in similar fashion to the inner liner tiles 361, 363. Such a configuration may also provide space savings because the outer skin 321 and studs 355 could be removed allowing the combustion housing 320 to be positioned closer to the outer case 318.

Another illustrative combustor 410 adapted for use in the gas turbine engine 110 is shown in FIGS. 11-14. The combustor 410 is substantially similar to the combustor 10 shown in FIGS. 2-8 described herein. Accordingly, similar reference numbers in the 400 series indicate features that are generally common between the combustor 10 and the combustor 410. The description of the combustor 10 is hereby incorporated by reference to apply to the combustor 410, except in instances when it conflicts with the specific description and drawings of combustor 410.

Figure 11:
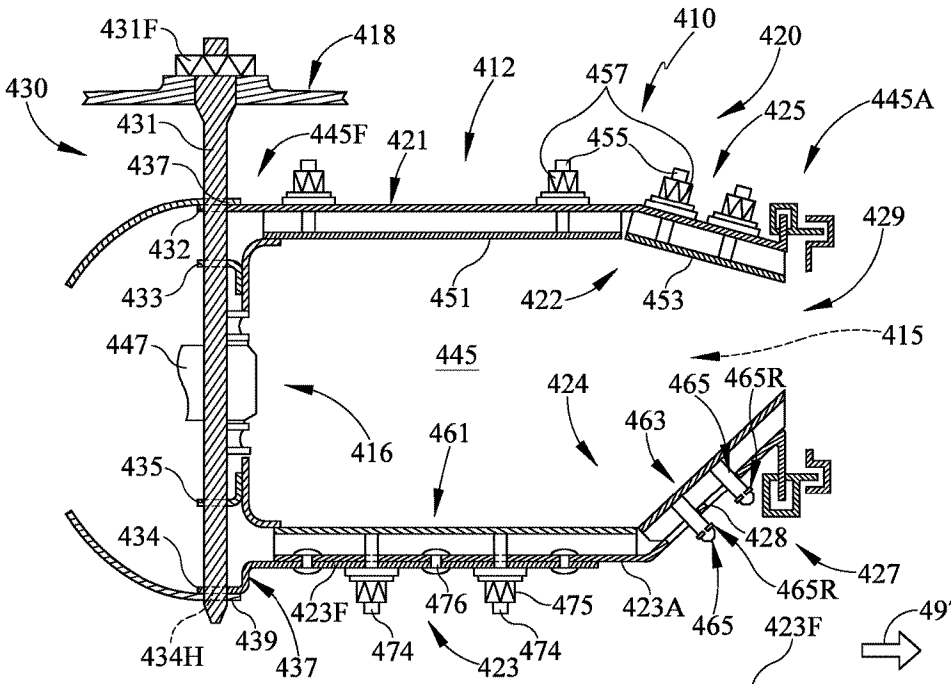
FIG. 11 is a partial cross-sectional view of a fourth combustor showing that the inner skin of the inner case includes a stud locator coupled to the mount pin and a stud retainer coupled to the stud locator for supporting studs coupled to an annular liner tile.
Figure 12:
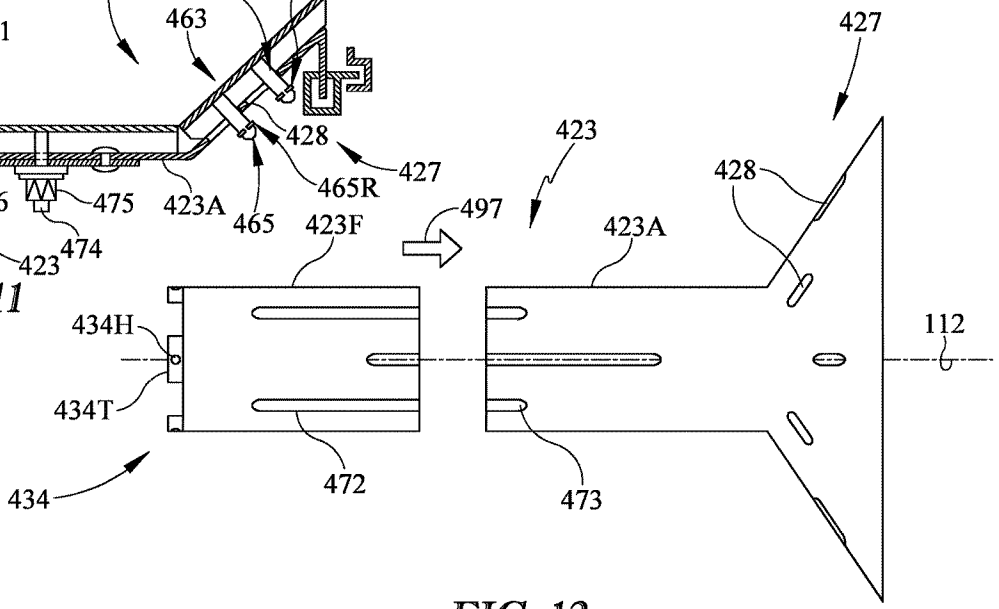
FIG. 12 is a side elevation view of the inner skin shown in FIG. 11 showing that the stud locator and stud retainer have corresponding slots and that the stud locator passes into the stud retainer to locate the annular liner tile relative to the outer case.

Unlike the combustor 10, the inner skin 423 of the combustion housing 420 included in the combustor 410 includes a forward portion (or stud locator) 423F and a separate aft portion (or stud retainer) 423A as shown in FIGS. 11 and 12. Further, the inner liner tile 461 does not include a tile hanger corresponding to the tile hanger 36 of the combustor 10. Rather, the inner liner tile 461 includes a plurality of radially-extending studs 474 arranged to pass through axially-extending slots 472, 473 of the forward and aft portions 423F, 423A of the inner skin 423. In the illustrative embodiment, the studs 474 of the monolithic annular inner liner tile 461 are trapped between corresponding ends of the slots 472, 473 and held in place with nuts 475.

In one embodiment, the studs 474 are axially and circumferentially offset from one another as shown in FIGS. 11 and 12. Similarly, the slots 472, 473 are sized and positioned corresponding to the studs 474. In the illustrative embodiment, the aft portion 423A of the inner skin 423 is sized to surround the forward portion 423F such that the forward portion 423F may pass into the aft portion 423A. However, it should be noted that the forward portion 423F may be sized to surround the aft portion 423A. During assembly of the combustion housing 420, the inner liner tile 461 passes over the aft portion 423A of the inner skin 423 such that the inner liner tile 461 surrounds at least part of the aft portion 423A and the studs 474 are positioned within the slots 473. The forward portion 423F of the inner skin 423 then passes into the aft portion 423A such that the studs 474 are positioned within the slots 472 and are trapped between corresponding ends of the slots 472, 473. In some embodiments, the inner liner tile 461 may be positioned relative to the forward portion 423F before being positioned relative to the aft portion 423A. In the illustrative embodiment, the forward portion 423F and aft portion 423A of the inner skin 423 are secured together using rivets 476 such that the forward and aft portions 423F, 423A form a single structure for mounting of the inner liner tile 461 relative to the outer case 418. Other methods of securing the forward portion 423F to the aft portion 423A are contemplated such as, for example, screws, bolts, or welding to name a few.

The forward portion 423F of the inner skin 423 includes an inner skin hanger 434 as shown in FIG. 12. The inner skin hanger 434 includes a plurality of circumferentially spaced hanger tabs 434 having holes 434H corresponding to the mount pins 431 for mounting the inner skin 423 relative to the outer case 418. The aft portion 423A of the inner skin 423 includes a radially sloped section (or mount plate) 427, similar to the mount plate 27 of the combustor 10, for mounting of the inner liner tile 463. The inner liner tile 463 may be mounted to the aft portion 423A of the inner skin 423 prior to mounting the inner liner tile 461. However, incorporation of other techniques and structures previously described herein may allow for alternate mounting orders.

Figure 13:
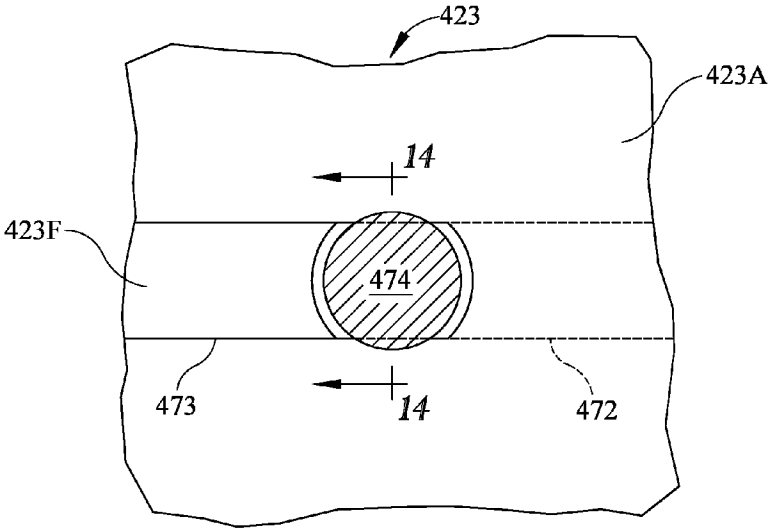
FIG. 13 is a partial side elevation view of the inner skin shown in FIG. 12 showing that the slots of the stud locator cooperate with the slots of the stud retainer to trap and locate the studs connected to the inner surface of the annular liner tile.
Figure 14:
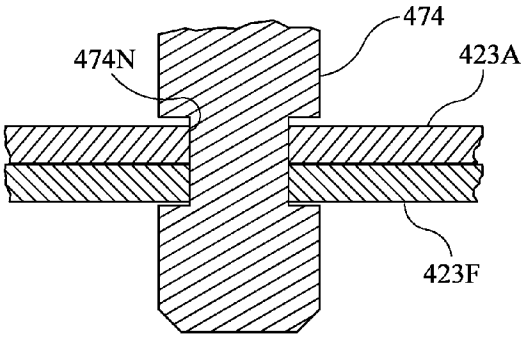
FIG. 14 is a partial cross-sectional view of the inner skin shown in FIG. 13 showing that the stud includes a notch to receive portions of the stud locator and stud retainer to retain the annular liner tile to the inner skin.

In an alternate embodiment of the combustor 410, the radially-extending studs 474 of the inner liner tile 461 may include notches 474N for securing the inner liner tile 461 to the inner skin as shown in FIGS. 13 and 14. The width of the slots 472, 473 of the forward and aft portions 423F, 423A of the inner skin 423 may be less than the diameter of the studs 474 such that a portion of the forward and aft portions 423F, 423A passes into the notch 474N. The corresponding ends of the slots 472, 473 trap the studs 474 to provide axial positioning of the inner liner tile 461 while the notch 474N retains the inner liner tile 461 to the inner skin 423. The notch 474N may be larger than the combined thickness of the forward and aft portions 423F, 423A of the inner skin 423 to allow for radial expansion of the inner liner tile 461 relative to the inner skin 423 due to the heat generated in the combustion chamber 445.

Figure 15:
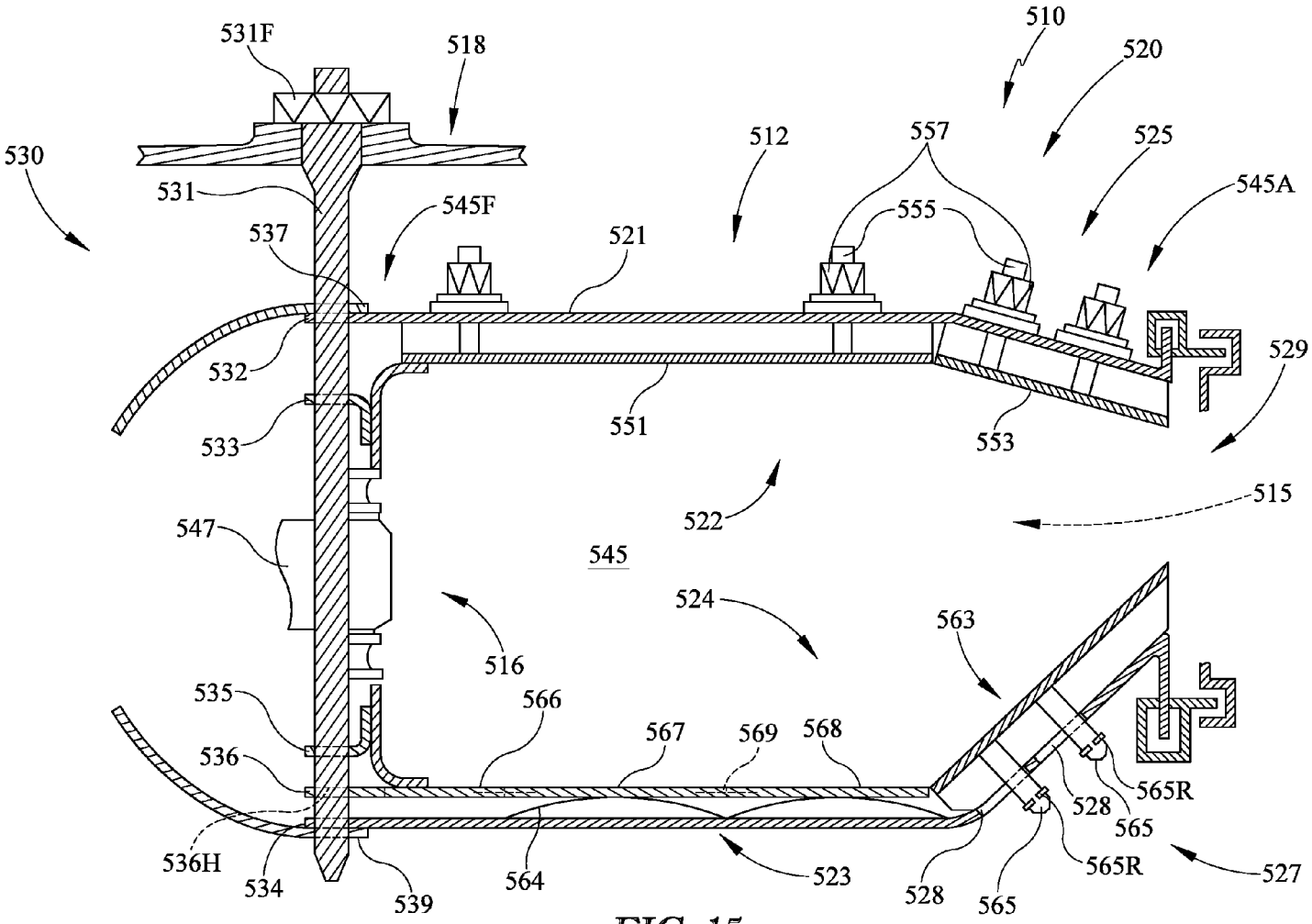
FIG. 15 is a partial cross-sectional view of a fifth combustor showing that multiple annular liner tiles may be positioned along the inner skin of the inner case.

Another illustrative combustor 510 adapted for use in the gas turbine engine 110 is shown in FIG. 15. The combustor 510 is substantially similar to the combustor 10 shown in FIGS. 2-8 described herein. Accordingly, similar reference numbers in the 500 series indicate features that are generally common between the combustor 10 and the combustor 510. The description of the combustor 10 is hereby incorporated by reference to apply to the combustor 510, except in instances when it conflicts with the specific description and drawings of combustor 510.

Unlike the combustor 10, a plurality of axially-adjacent annular inner liner tiles 566, 567, 568 are used instead of a single monolithic annular liner tile 61 as shown in FIG. 15. In the illustrative embodiment, each of the annular inner liner tiles 566, 567, 568 are sized to surround a portion of the inner skin 523. In other illustrative embodiments, more or less inner liner tiles may be used in place of the inner liner tile 61. The first inner liner tile 566 includes a tile hanger 536 arranged to cooperate with the mount pins 531 to couple the first inner liner tile 566 to the outer case 518. The second inner liner tile 567 is positioned axially-adjacent to the first inner liner tile 566 and is coupled thereto using a strip seal 569. Other types of seals may also be used between the adjacent inner liner tiles. The third inner liner tile 568 is positioned axially-adjacent to the second inner liner tile 567 and is coupled thereto using another strip seal 569. The first inner liner tile 566 is arranged to trap the second and third inner liner tiles 567, 568 against the inner liner tile 563 to provide axial positioning of the inner liner tiles 567, 568 relative to the outer case 518. Leaf springs 564 may be positioned between the inner skin 523 and the second and third inner liner tiles 567, 568 to provide radial positioning of the second and third inner liner tiles 567, 568 relative to the outer case 518. Other suitable elements may also be used to provide radial positioning of the second and third inner liner tiles 567, 568.

In one embodiment, the inner liner tile 563 is coupled to the inner skin 523 as described previously with regard to the combustor 10 of FIGS. 2-8. A leaf spring 564 may then be positioned on the inner skin 523 and the third inner liner tile 568 may be positioned to surround the leaf spring 564 and a portion of the inner skin 523 axially adjacent to the inner liner tile 563. Another leaf spring 564 may then be positioned on the inner skin 523 and the second inner liner tile 567 may be positioned to surround the leaf spring 564 and a portion of the inner skin 523 axially adjacent to the third inner liner tile 568. The strip seal 569 may be pre-positioned on either of the second or third inner liner tiles 567, 568 to couple the second and third inner liner tiles 567, 568 together. Alternatively, the strip seal 569 may be coupled to the third inner liner tile 568 prior to positioning and coupling the second inner liner tile 567 thereto. The first inner liner tile 566 may then be positioned to align the tile hanger 536 with the mount pins 531 to trap the second and third inner liner tiles 567, 568 against the inner liner tile 563. The strip seal 569 may be pre-positioned on either of the first or second inner liner tiles 566, 567 to couple the first and second inner liner tiles 566, 567 together. Alternatively, the strip seal 569 may be coupled to the second inner liner tile 567 prior to positioning and coupling the first inner liner tile 566 thereto.

The structures and methods of assembly described above in regard to the inner liner walls 24, 224, 324, 424, and 524 of the combustors 10, 210, 310, 410, and 510 apply equally to the outer liner walls 22, 222, 322, 422, and 522. Various orders of assembly for each of the above described combustors 10, 210, 310, 410, and 510 is contemplated and may depend on the combination of components included in a particular combustor. The terms monolithic, full-annular, and annular are meant to describe components which are substantially continuous, monolithic, integral, and unitary, and also, with regard to the combustion liner and liner walls, does not contain axially-extending joints.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A combustor for use in a gas turbine engine, the combustor comprising an outer case, a combustion liner arranged radially inward of the outer case and arranged to define an annular combustion chamber, the combustion liner including at least one monolithic annular liner tile, and a mount assembly coupled to the outer case and to the combustion liner to locate the at least one monolithic annular liner tile relative to the outer case, wherein the mount assembly extends from the outer case to the at least one monolithic annular liner tile to locate the combustion liner relative to the outer case and wherein the mount assembly includes at least three mount pins circumferentially spaced apart from one another and a tile hanger that extends from the at least one monolithic annular liner tile to receive each of the at least three mount pins.

2. The combustor of claim 1, wherein the tile hanger includes at least three hanger tabs that extend from the at least one monolithic annular liner tile and the hanger tabs are circumferentially spaced apart from one another to correspond to the at least three mount pins.

3. The combustor of claim 1, wherein the combustion liner includes a plurality of circumferentially adjacent liner tiles arranged radially outward of the at least one monolithic annular liner tile and the combustion chamber extends radially between the plurality of circumferentially adjacent liner tiles and the at least one monolithic annular liner tile.

4. The combustor of claim 1, further comprising an inner case that defines an annular liner-receiving cavity in which the combustion liner is mounted, and wherein the mount assembly extends from the outer case to the inner case to locate the inner case and the combustion liner relative to the outer case.

5. The combustor of claim 4, wherein the at least one monolithic annular liner tile is coupled to the inner case by a plurality of studs that extend radially from the at least one monolithic annular liner tile to the inner case.

6. The combustor of claim 1, wherein the combustion liner includes a first monolithic annular liner tile and a second monolithic annular liner tile.

7. The combustor of claim 6, wherein the second monolithic annular liner tile is arranged radially outward of the first monolithic annular liner tile and the combustion chamber extends radially between the second monolithic annular liner tile and the first monolithic annular liner tile.

8. The combustor of claim 7, wherein the mount assembly includes a second tile hanger that extends from the second monolithic annular liner tile to receive each of the mount pins.

9. The combustor of claim 6, wherein the second monolithic annular liner tile is arranged axially adjacent to the first monolithic annular liner tile.

10. A combustor for use in a as turbine engine, the combustor comprising an outer case, a combustion liner arranged radially inward of the outer case and arranged to define an annular combustion chamber, the combustion liner including a first monolithic annular liner tile and a second monolithic annular liner tile, wherein the first monolithic annular liner tile is substantially cylindrical and the second monolithic annular liner tile is substantially frustoconical, and a mount assembly coupled to the outer case and to the combustion liner to locate the at least one monolithic annular liner tile relative to the outer case.

11. A combustor for use in a gas turbine engine, the combustor comprising an outer case, a combustion liner arranged radially inward of the outer case and arranged to define an annular combustion chamber, the combustion liner including at least one monolithic annular liner tile, an inner case that defines an annular liner-receiving cavity in which the combustion liner is mounted, and a mount assembly coupled to the outer case and to the combustion liner to locate the at least one monolithic annular liner tile relative to the outer case, wherein the mount assembly extends from the outer case to the inner case to locate the inner case and the combustion liner relative to the outer case, wherein the at least one monolithic annular liner tile is coupled to the inner case by a plurality of studs that extend radially from the at least one monolithic annular liner tile to the inner case, and wherein the inner case includes a stud locator formed to include a first plurality of axially-extending slots and a stud retainer formed to include a second plurality of axially-extending slots, and the first and second plurality of axially-extending slots cooperate to axially trap the plurality of studs that extend from the at least one monolithic annular liner tile when the combustor is assembled.

12. A method of assembling a combustor for use in a gas turbine engine, the method comprising positioning a combustion liner radially inward of an outer case, the combustion liner arranged to define an annular combustion chamber that extends around a central axis and including at least one monolithic annular liner tile that extends around the central axis, and securing a plurality of mount pins to the outer case, the mount pins being circumferentially spaced from one another and engaging the at least one monolithic annular liner tile to locate the at least one monolithic annular liner tile relative to the outer case, wherein the combustion liner includes a first monolithic annular liner tile and a second monolithic annular liner tile, the first monolithic annular liner tile engaged by the plurality of mount pins, the second monolithic annular liner tile being formed to taper from a first axial end having a first diameter to a second axial end having a second diameter different from the first diameter.

13. The method of claim 12, wherein the method further comprises mounting the second monolithic annular liner tile relative to the outer case by moving the second monolithic annular liner tile along the central axis and passing a plurality of studs that extend from the second monolithic annular liner tile in a substantially perpendicular direction from the second monolithic annular liner tile into axially and radially extending slots formed in a mount plate.

14. A combustor for use in a gas turbine engine, the combustor comprising a mount plate formed to include a first axial end, a second axial end, and a plurality of slots circumferentially spaced from one another, the first axial end having a first diameter and the second axial end having a second diameter different than the first diameter, a combustion liner arranged to define an annular combustion chamber, the combustion liner including at least a first monolithic annular liner tile, the first monolithic annular liner tile being formed to include a first axial end and a second axial end, the first axial end having a first diameter and the second axial end having a second diameter different than the first diameter corresponding to the first and second diameters of the first and second axial ends of the mount plate, and a plurality of studs that extend substantially perpendicularly from the inner surface of the first monolithic annular liner tile and are circumferentially spaced from one another to correspond to the plurality of slots to be received therein to couple the first monolithic annular liner tile to the mount plate.

15. The combustor of claim 14, further comprising an inner case that defines an annular liner-receiving cavity in which the combustion liner is mounted, and wherein the inner case includes the mount plate.

16. The combustor of claim 14, wherein the combustion liner includes a second monolithic annular liner tile, and wherein the second monolithic annular liner tile includes the mount plate.

17. The combustor of claim 14, wherein the combustion liner includes a second monolithic annular liner tile, and wherein the mount plate is coupled to the second monolithic annular liner tile by a series of fasteners.

18. The combustor of claim 14, wherein the plurality of the slots includes at least a first slot and a second slot, the first slot being radially and axially spaced apart from the second slot, and wherein the plurality of studs includes at least a first stud and a second stud, the first stud being radially and axially spaced apart from the second stud received in the first and second slots.

* * * * *